US006580895B2

(12) United States Patent
Hirst et al.

(10) Patent No.: US 6,580,895 B2
(45) Date of Patent: Jun. 17, 2003

(54) FUSING SYSTEM INCLUDING A HEAT DISTRIBUTION MECHANISM

(75) Inventors: B. Mark Hirst, Boise, ID (US); Mark Wibbels, Boise, ID (US); Kenneth E. Heath, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/819,503

(22) Filed: Mar. 28, 2001

(65) Prior Publication Data

US 2002/0141795 A1 Oct. 3, 2002

(51) Int. Cl.[7] ..... G03G 15/20

(52) U.S. Cl. ..... 399/330; 165/89; 219/216; 219/469; 399/328

(58) Field of Search ..... 399/328, 330, 399/333, 334, 320; 219/216, 469; 118/60; 492/46; 165/89, 90

(56) References Cited

U.S. PATENT DOCUMENTS

| | | | | |
|---|---|---|---|---|
| 5,300,996 A | * | 4/1994 | Yokoyama et al. | 399/333 X |
| 5,773,796 A | * | 6/1998 | Singer et al. | 219/216 X |
| 5,789,723 A | | 8/1998 | Hirst | 219/501 |
| 5,819,150 A | * | 10/1998 | Hayasaki et al. | 399/330 |
| 5,839,043 A | | 11/1998 | Okabayashi et al. | 399/329 |
| 5,890,047 A | * | 3/1999 | Moser | 399/330 X |
| 5,984,848 A | | 11/1999 | Hyllberg et al. | 492/46 |
| 6,018,151 A | | 1/2000 | Hirst | 219/497 |
| 6,122,478 A | | 9/2000 | Hirst | 399/330 |
| 6,181,891 B1 | | 1/2001 | Higashi et al. | 399/70 |
| 6,339,211 B1 | * | 1/2002 | Foote et al. | 219/216 |

FOREIGN PATENT DOCUMENTS

| | | |
|---|---|---|
| JP | 08-262905 | * 10/1996 |
| JP | 10-301426 | * 11/1998 |

* cited by examiner

*Primary Examiner*—Sophia S. Chen

(57) ABSTRACT

The present disclosure relates to a fusing system for fusing toner to a recording medium. In one embodiment, the fusing system contains a fuser roller configured as a heat pipe including an inner tube and a coaxial outer tube that is mounted to the inner tube, the inner and outer tubes defining an interior space therebetween that is adapted to contain a liquid and to be evacuated so as be maintained in a vacuum, and a pressure roller in contact with the fuser roller. In another embodiment, the fusing system contains a fuser roller, a pressure roller in contact with the fuser roller, and an external heating roller in contact with the fuser roller, the external heating roller being configured as a heat pipe including an inner tube and a coaxial outer tube that is mounted to the inner tube, the inner and outer tubes defining an interior space therebetween that is adapted to contain a liquid and to be evacuated so as be maintained in a vacuum.

19 Claims, 8 Drawing Sheets

FUSING SYSTEM INCLUDING A HEAT DISTRIBUTION MECHANISM

FIELD OF THE INVENTION

The present disclosure relates to a fusing system including a heat distribution mechanism. More particularly, the disclosure relates to a fusing system including a heat pipe that can be used to distribute heat across the fusing system.

BACKGROUND OF THE INVENTION

Electrophotographic printing and copying devices typically are provided with fusing systems that serve to thermally fuse a toner image onto a recording medium, such as a sheet of paper. Such fusing systems normally comprise a heated fuser roller and a heated pressure roller that presses against the fuser roller to form a nip in which the fusing occurs. The fuser and pressure rollers typically comprise hollow tubes that surround internal heating elements and are coated with outer layers of elastomeric material.

The internal heating elements typically comprise heating lamps and/or nichrome heating elements that uniformly irradiate the inner surfaces of the rollers. Through this irradiation, the inner surfaces are heated and this heat diffuses to the outer surfaces of the fuser and pressure rollers until they reach a temperature sufficient to melt the toner (e.g., approximately between 160° C. to 190° C.). The fuser roller and the pressure rollers rotate in opposite directions and are urged together so as to form a nip that compresses the outer layers of the rollers together. The compression of these layers increases the width of the nip, which increases the time that the recording medium resides in the nip. The longer the dwell time in the nip, the larger the total energy that the toner and recording medium can absorb to melt the toner. Within the nip, the toner is melted and fused to the medium by the pressure exerted on it by the two rollers. After the toner has been fused, the recording medium is typically forwarded to a discharge roller that conveys the medium to a discharge tray.

During use of the device, thermal loads are applied to the fusing system from contact with the recording media during fusing. The temperature of the roller outer surfaces drops at regions in which contact is made with the recording media. If the thermal load is not uniform across the surface of the rollers (i.e., if the media is more narrow than the length of the rollers) a non-uniform temperature distribution (i.e., temperature gradient) results. For example, when relatively narrow media (e.g., envelopes, postcards, etc.) are passed through the fusing system, the temperatures on the outer surfaces of the rollers will be much lower where contact is made with the media as compared to areas in which such contact is not made.

Typically, the temperature of these surfaces is controlled using negative feedback. For instance, when a thermal load is applied to the fuser and pressure rollers, the power supplied to the rollers is increased to maintain the operating temperature of the rollers. In that the outer layers of the rollers are normally constructed of rubber materials (e.g., silicon rubber) that have high thermal resistance, and since the rollers are normally internally heated, the return to operating temperature is delayed by the outer layers. Because heating of the rollers is not limited to the areas at which a thermal load is applied, such heating can raise the temperatures of the unloaded regions of the outer layers, typically adjacent the ends of the rollers, to the point at which degradation (e.g., delamination) of the layers can occur. Notably, such damage can also occur even where internal heating is not used in that destructive temperature gradients can be created across the length of the fusing system rollers any time the width of the recording media is smaller than the length of the rollers.

From the foregoing, it can be appreciated that it would be desirable to have a fusing system in which thermal gradients that arise during use can be quickly reduced such that a substantially even heat distribution is maintained across the fusing system rollers.

SUMMARY OF THE INVENTION

The present disclosure relates to a fusing system for fusing toner to a recording medium. In one embodiment, the fusing system comprises a fuser roller configured as a heat pipe including an inner tube and a coaxial outer tube that is mounted to the inner tube, the inner and outer tubes defining an interior space therebetween that is adapted to contain a liquid and to be evacuated so as be maintained in a vacuum, and a pressure roller in contact with the fuser roller. In another embodiment, the fusing system comprises a fuser roller, a pressure roller in contact with the fuser roller, and an external heating roller in contact with the fuser roller, the external heating roller being configured as a heat pipe including an inner tube and a coaxial outer tube that is mounted to the inner tube, the inner and outer tubes defining an interior space therebetween that is adapted to contain a liquid and to be evacuated so as be maintained in a vacuum.

The present disclosure also relates to a method for distributing heat within a fusing system. In one embodiment, the method comprises the steps of providing a fuser roller including an interior space maintained in a vacuum that contains a liquid, heating the fuser roller until the liquid within the interior space is vaporized, and distributing heat within the fuser roller via continual condensation and re-vaporization of the vaporized liquid within the interior space. In another embodiment, the method comprises the steps of providing an external heating roller including an interior space maintained in a vacuum that contains a liquid, placing the external heating roller in rolling contact with a fuser roller of the fusing system, heating the external heating roller until the liquid within the interior space is vaporized, and distributing heat within the external heating roller via continual condensation and re-vaporization of the vaporized liquid within the interior space.

The features and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Figure 1:
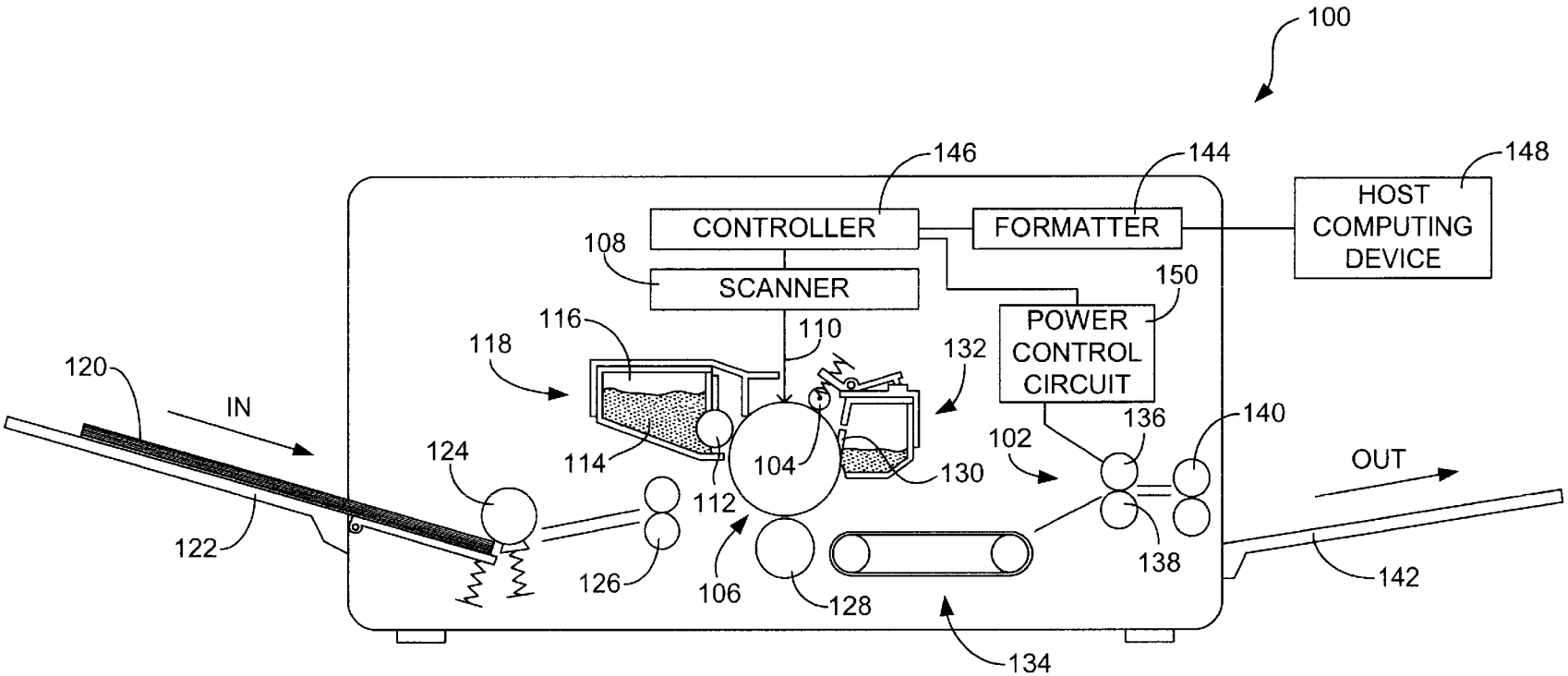
FIG. 1 is a schematic side view of an electrophotographic imaging device incorporating a first fusing system.

Referring now in more detail to the drawings, in which like numerals indicate corresponding parts throughout the several views, FIG. 1 illustrates a schematic side view of an electrophotographic imaging device 100 that incorporates a first fusing system 102. By way of example, the device 100 comprises a laser printer. It is to be understood, however, that the device 100 can, alternatively, comprise any other such imaging device that uses a fusing system including, for instance, a photocopier or a facsimile machine.

As indicated in FIG. 1, the device 100 includes a charge roller 104 that is used to charge the surface of a photoconductor drum 106, to a predetermined voltage. A laser diode (not shown) is provided within a laser scanner 108 that emits a laser beam 110 which is pulsed on and off as it is swept across the surface of the photoconductor drum 106 to selectively discharge the surface of the photoconductor drum. In the orientation shown in FIG. 1, the photoconductor drum 106 rotates in the counterclockwise direction. A developing roller 112 is used to develop a latent electrostatic image residing on the surface of photoconductor drum 106 after the surface voltage of the photoconductor drum has been selectively discharged. Toner 114 is stored in a toner reservoir 116 of an electrophotographic print cartridge 118. The developing roller 112 includes an internal magnet (not shown) that magnetically attracts the toner 114 from the print cartridge 118 to the surface of the developing roller. As the developing roller 112 rotates (clockwise in FIG. 1), the toner 114 is attracted to the surface of the developing roller 112 and is then transferred across the gap between the surface of the photoconductor drum 106 and the surface of the developing roller to develop the latent electrostatic image.

Recording media 120, for instance sheets of paper, are loaded from an input tray 122 by a pickup roller 124 into a conveyance path of the device 100. Each recording medium 120 is individually drawn through the device 100 along the conveyance path by drive rollers 126 such that the leading edge of each recording medium is synchronized with the rotation of the region on the surface of the photoconductor drum 106 that comprises the latent electrostatic image. As the photoconductor drum 106 rotates, the toner adhered to the discharged areas of the drum contacts the recording medium 120, which has been charged by a transfer roller 128, such that the medium attracts the toner particles away from the surface of the photoconductor drum and onto the surface of the medium. Typically, the transfer of toner particles from the surface of the photoconductor drum 106 to the surface of the recording medium 120 is not completely efficient. Therefore, some toner particles remain on the surface of the photoconductor drum. As the photoconductor drum 106 continues to rotate, the toner particles that remain adhered to the drum's surface are removed by a cleaning blade 130 and deposited in a toner waste hopper 132.

As the recording medium 120 moves along the conveyance path past the photoconductor drum 106, a conveyer 134 delivers the recording medium to the fuser system 102. The recording medium 120 passes between a fuser roller 136 and a pressure roller 138 of the fusing system 102 that are described in greater detail below. As the pressure roller 138 rotates, the fuser roller 136 is rotated and the recording medium 120 is pulled between the rollers. The heat applied to the recording medium 120 by the fusing system 102 fuses the toner to the surface of the recording medium. Finally, output rollers 140 draw the recording medium 120 out of the fusing system 102 and deliver it to an output tray 142.

As identified in FIG. 1, the device 100 can further include a formatter 144 and a controller 146. The formatter 144 receives print data, such as a display list, vector graphics, or raster print data, from a print driver operating in conjunction with an application program of a separate host computing device 148. The formatter 144 converts the print data into a stream of binary print data and sends it to the controller 146. In addition, the formatter 144 and the controller 146 exchange data necessary for controlling the electrophotographic imaging process. In particular, the controller 146 supplies the stream of binary print data to the laser scanner 108. The binary print data stream sent to the laser diode within the laser scanner 108 pulses the laser diode to create the latent electrostatic image on the photoconductor drum 106.

In addition to providing the binary print data stream to the laser scanner 108, the controller 146 controls a high voltage power supply (not shown) that supplies voltages and currents to the components used in the device 100 including the charge roller 104, the developing roller 112, and the transfer roller 128. The controller 146 further controls a drive motor (not shown) that drives the printer gear train (not shown) as well as the various clutches and feed rollers (not shown) necessary to move recording media 120 through the conveyance path of the device 100.

A power control circuit 150 controls the application of power to the fusing system 102. In a preferred arrangement, the power control circuit 150 is configured in the manner described in U.S. Pat. Nos. 5,789,723 and 6,018,151, which are hereby incorporated by reference into the present disclosure, such that the power to the fusing system 102 is linearly controlled and the power levels can be smoothly ramped up and down as needed. As described in these patents, such control provides for better control over the amount of heat generated by the fusing system 102. While the device 100 is waiting to begin processing a print or copying job, the temperature of the fuser roller 136 is kept at a standby temperature corresponding to a standby mode. In the standby mode, power is supplied at a reduced level to the fuser roller 136 by the power control circuit 150 to reduce power consumption, lower the temperature, and reduce the degradation resulting from continued exposure to the components of the fusing system 102 to the fusing temperatures.

The standby temperature of the fuser roller 136 is selected to balance a reduction in component degradation against the time required to heat the fuser roller from the standby temperature to the fusing temperature. From the standby temperature, the fuser roller 136 can be quickly heated to the temperature necessary to fuse toner to the recording media 120. When processing of a fusing job begins, the controller 146, sufficiently ahead of the arrival of a recording medium 120 at the fusing system 102, increases the power supplied by the power control circuit 150 to the fusing system to bring its temperature up to the fusing temperature. After completion of the fusing job, the controller 146 sets the power control circuit 150 to reduce the power supplied to the fusing system to a level corresponding to the standby mode. The cycling of the power supplied to fusing system 102 is ongoing during operation of the device as fusing jobs are received and processed and while the device is idle.

Figure 2:
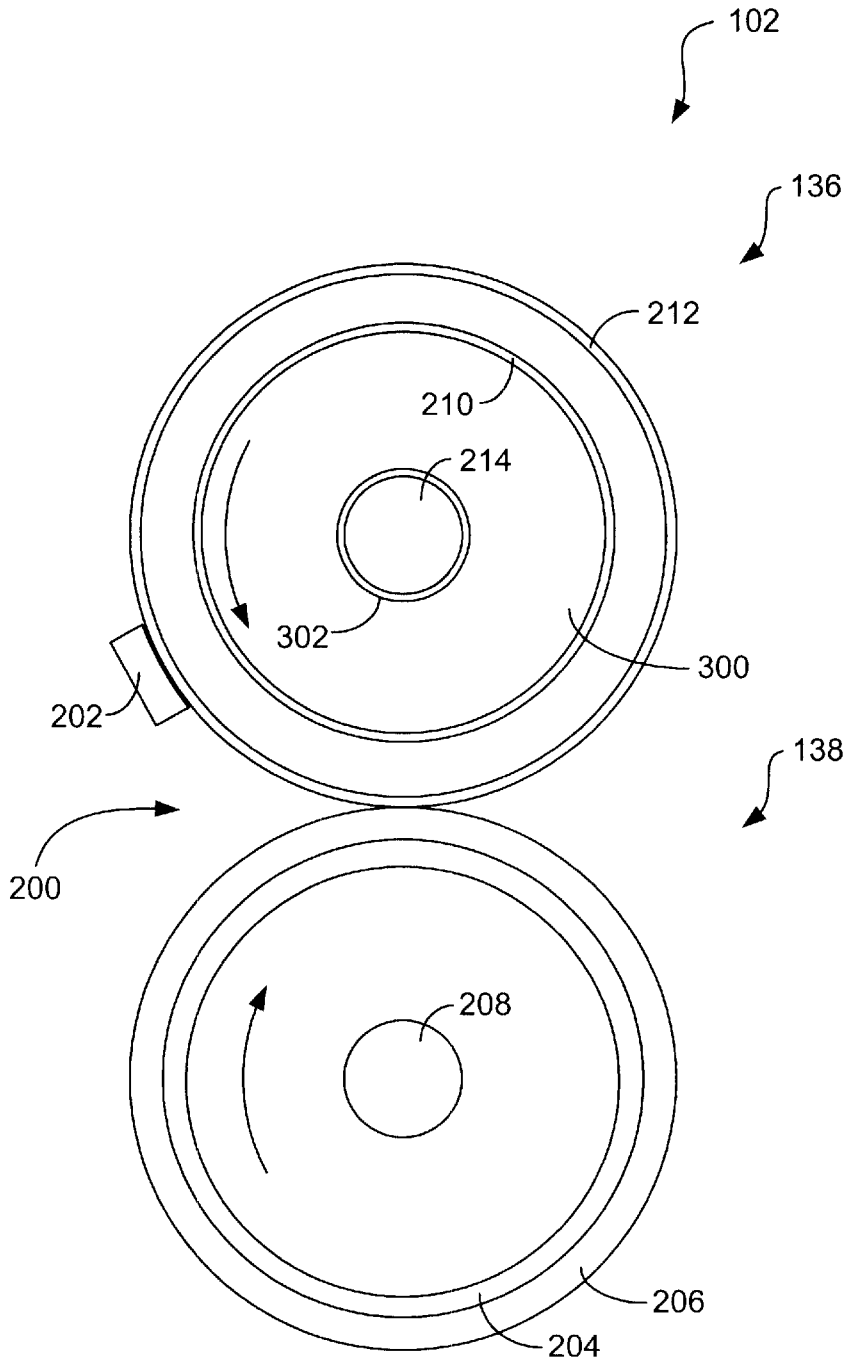
FIG. 2 is a simplified end view of the fusing system shown in FIG. 1.

FIG. 2 illustrates a simplified end view of the fusing system 102 shown in FIG. 1. As indicated in FIG. 2, the fusing system 102 generally comprises the fuser roller 136 and the pressure roller 138 that together form a nip 200 therebetween. In addition, the fusing system 102 includes a temperature sensor 202 that is associated with the fuser roller 136. The construction of the fuser roller 136 is discussed in detail below. As will be apparent from that discussion, the fuser roller 136 is designed as a heat pipe that equalizes temperatures across the nip 200 of the fusing system 102.

The pressure roller 138 typically is formed as a hollow tube 204. By way of example, the tube 204 is composed of a metal such as aluminum or steel and has a diameter of approximately 45 millimeters (mm). By further way of example, the tube 204 has a thickness of approximately 2.5 mm. The pressure roller 138 is provided with an outer layer 206 of an elastomeric material such as silicon rubber or a flexible thermoplastic that has a thickness of, for instance, approximately 4 mm. To prevent toner from adhering to the outer layer 206, a layer of TEFLON® (not visible in FIG. 2) can be applied to the outer layer. This layer of TEFLON® can, for instance, have a thickness of approximately 1.5 to 2 mils.

Inside the pressure roller 138 is an internal heating element 208 that, by way of example, comprises a halogen lamp or a nichrome heating element. Normally, the heating element 208 is at least as long as the roller 138 such that the element can be fixedly mounted in place beyond the ends of the roller. When formed as a tungsten filament halogen lamp, the internal heating element 208 can have a power rating of, for example, approximately 100 watts (W) to 600 W. It is to be noted that, although an internal heating element 208 is shown and described, the pressure roller 138 could, alternatively, be configured without its own heat source. Preferably, however, such a heat source is provided to avoid the accumulation of toner on the pressure roller 138 during use.

The temperature sensor 202 typically comprises a thermistor that is placed in close proximity to or in contact with the fuser roller 136 at a position adjacent the entry of the nip 200. Although this placement is preferred, it will be appreciated that other placement is also feasible. In an alternative arrangement, the sensor 202 can comprise a non-contact thermopile (not shown). Although non-contact thermopiles are preferable from the standpoint of reliability, they are more expensive and therefore increase the cost of the device 100.

As indicated in FIG. 2, the fuser roller 136 generally comprises an inner tube 210 and a coaxial outer tube 212 that surrounds the inner tube. Each of the inner and outer tubes 210 and 212 is hollow and typically composed of a metal such as aluminum, copper, or steel. Of these metals, copper is preferred due to its high thermal conductivity and resistance to high pressures. By way of example, the inner tube 210 can have a diameter of approximately 1⅝ inches (in) and a thickness of approximately 0.06 in, while the outer tube 212 can have a diameter of approximately 2⅛ in and a thickness of approximately 0.08 in. Typically, the outer surface of the outer tube 212 is coated with a layer of TEFLON® to prevent toner from accumulating on the fuser roller 136. This layer of TEFLON® can, for instance, have a thickness of approximately 1.5 to 2 mils. Disposed within the inner tube 210 is an internal heating element 214 that, similar to element 208 of the pressure roller 138, typically comprises a tungsten filament halogen lamp or a nichrome heating element. Alternatively, the internal heating element can comprise an induction heating element.

Figure 3:
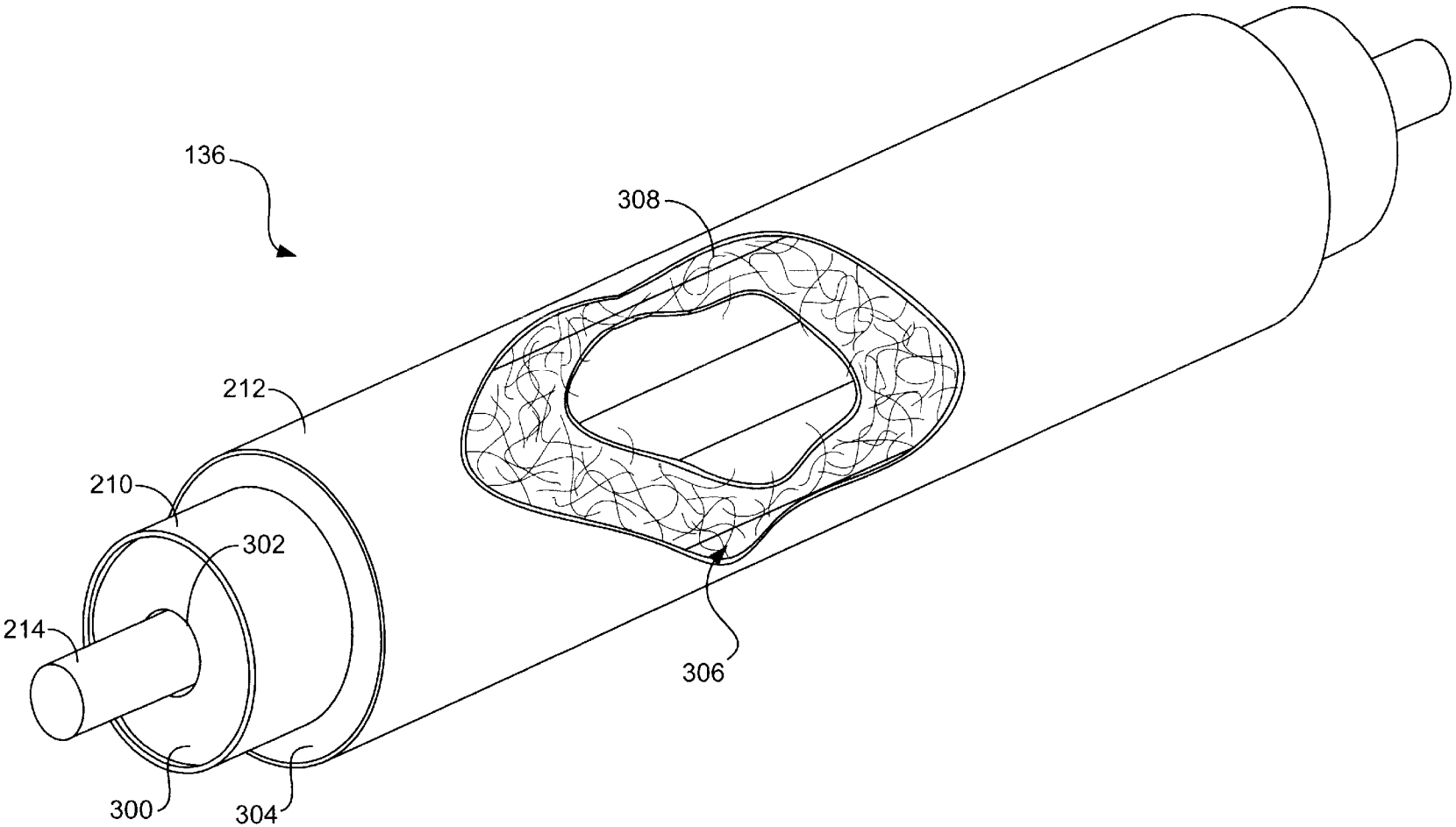
FIG. 3 is cut-away perspective view of a fuser roller of the fusing system shown in FIG. 2.
Figure 4:
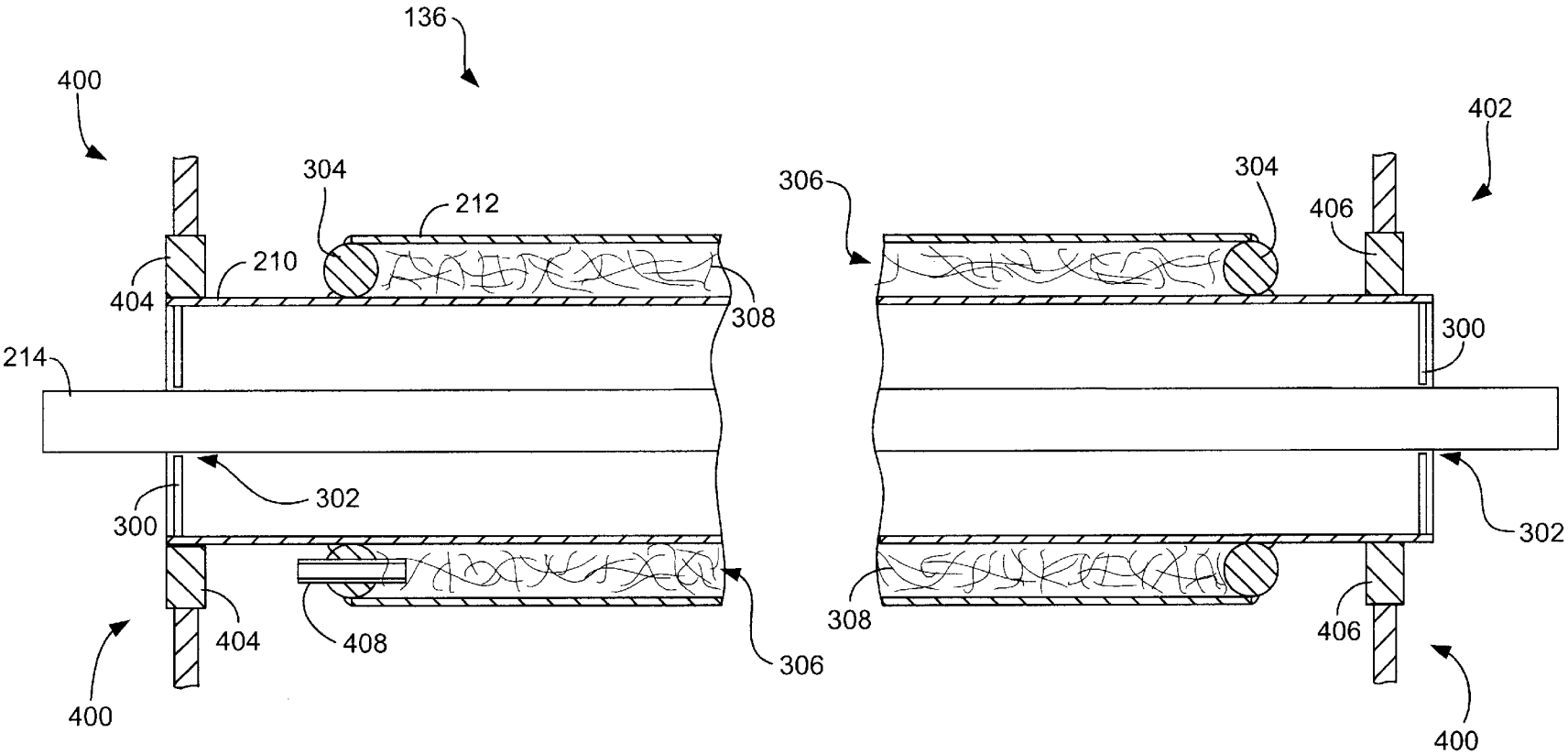
FIG. 4 is a partial, cross-sectional side view of the fuser roller shown in FIG. 3, showing an example mounting arrangement for the roller.

The fuser roller 136 is illustrated in greater detail in FIGS. 3 and 4. In that the outer tube 212 forms part of the nip 200 (FIG. 2), the outer tube normally is at least approximately 12 in long such that standard 8½ by 11 in paper can be passed through the fusing system 102 in a lengthwise orientation. To facilitate mounting of the fuser roller 136 within the fusing system 102, the inner tube 210 is normally longer than the outer tube 212, for instance extending at least approximately 1 in beyond each end of the outer tube. As identified in FIG. 4, this mounting is typically facilitated by mounting brackets 400 and 402 that surround both ends of the inner tube 210. The mounting brackets 400 and 402 comprise inner bearings 404 and 406, respectively, that rotatably support the fusing roller 136 in place. Typically, bearing 404 is arranged as a fixed bearing, and bearing 406 is arranged as a sliding bearing such that the inner tube 210 is free to expand in its length direction (to the right in FIG. 4) as its temperature is raised during use.

The internal heating element 214 normally extends beyond the ends of the inner tube 210 such that the element can be fixedly supported within the fusing system 102 with appropriate mounting brackets (not shown). As shown in FIGS. 3 and 4, the inner tube 210 can include air dams 300 that are mounted within the tube adjacent its ends that decrease convection loss from within the inner tube. The air dams 300 each include an aperture 302 through which the heating element 214 extends. To further prevent heat loss, the interior of the inner tube 210 can be coated with a black oxide layer or layer of black paint that absorbs heat radiation in similar fashion to a black body.

The outer tube 212 is supported in position about the inner tube 210 by spacers 304. As indicated in FIG. 4, these spacers 304 can, by way of example, comprise toroidal rings composed of a metal such as copper that are welded or braised in place between the inner and outer tubes 210 and 212. Although toroidal rings are depicted and described, it will be appreciated that the particular configuration of the spacers 304 is unimportant. Therefore, other configurations are feasible such as flat rings. In addition to supporting the outer tube 212 about the inner tube 210, the spacers 304 further act as end walls for an interior space 306 that is formed between the inner and outer tubes. Because this space 306 is defined by the outer surface of the inner tube 210 and the inner surface of the outer tube 212, the interior space 306 is generally cylindrical. By way of example, the interior space 306 can have a volume of approximately 13 cubic in.

Preferably disposed within the interior space 306 is wicking material 308 that, as is discussed below, can be used to draw condensation away from cold spots along the length of the outer tube 212. By way of example, the wicking material 308 can comprise copper gauze, copper mesh, steel wool, or combinations thereof. Although use of wicking material is preferred, it will be appreciated that, depending upon operating conditions and fusing system construction, such material may not be necessary. With reference to FIG. 4, the fuser roller 136 can further include a port 408 that is in fluid communication with the interior space 306. The port 408 is used to both inject liquid into the interior space 306 and evacuate air from the space to provide a mechanism for temperature equalization across the nip of the fusing system 102. In one arrangement, the liquid comprises water. Use of water is advantageous in that it is low cost, non-toxic, and has a wide useful temperature range. In another arrangement, the liquid can comprise ethylene glycol. Use of ethylene glycol is advantageous where the inner and/or outer tubes 210 and 212 are composed of copper in that ethylene glycol is highly compatible with copper. In addition, ethylene glycol has a lower vapor pressure than water at fusing system operating temperatures (e.g., approximately 185° C. to 195° C.). Accordingly, where ethylene glycol is used, thinner walled tubes can be used in the construction of the fuser roller 136. In either case, normally only a small volume of liquid is needed, e.g. 3 to 4 cubic centimeters. After the liquid has been injected into the interior space 306, the space is evacuated such that the interior space 306 is maintained in a vacuum. By way of example, the pressure within the interior space 306 after evacuation can be approximately 1 in of mercury (Hg) for water and approximately 70 microns of Hg for ethylene glycol. Once evacuation has been completed, the interior space 306 is sealed, for example by crimping the port 408 or welding or braising it shut.

In operation, the fuser and pressure rollers 136 and 138 are heated by the internal heating elements 208 and 214. Once the fusing system 102 is heated to operating temperature, the liquid within the interior space 306 of the fusing roller 136 is vaporized. Recording media can then be passed through the nip 200 to fuse toner to the media. Where the width of the media is smaller than the width of the nip 200, temperature gradients will begin to be formed along the lengths of the rollers 136 and 138. In particular, these gradients will be formed at the transition regions between thermally loaded and un-loaded portions of the rollers 136 and 138. However, due to the construction of the fuser roller 136 described above, heat is distributed across the lengths of the rollers 136 and 138 to reduce the magnitude of these gradients.

As the temperature gradients are formed, the relatively cool regions condense the vapor contained within the interior space 306 of the fuser roller 136 into liquid form. This change of state releases a large amount of energy that warms the relatively cool regions. The condensed liquid then is quickly drawn away to relatively hot regions, for instance with the wicking material 308 under a capillary effect. Because of the high temperature of these relatively hot regions, the liquid is again vaporized. This vaporization removes heat from the relatively hot regions and lowers their temperature. These changes of state occur continually within the interior space 306 during use of the fusing system 102. Operating in this manner, the fusing system 102, and more particularly the fuser roller 136, redistributes heat from relatively hot regions to relatively cool regions, thereby reducing the magnitude of the temperature differential over the length of fuser and pressure rollers 136 and 138, and thereby reducing the likelihood of degradation of the outer layer 206 of the pressure roller. In addition to extending the useful life of the fusing system 102, this heat redistribution increases the efficiency of the fusing system 102 in that less energy is wasted in heating (and normally overheating) the portions of the rollers not subjected to thermal loads by the recording media passing through the nip 200.

Figure 5:
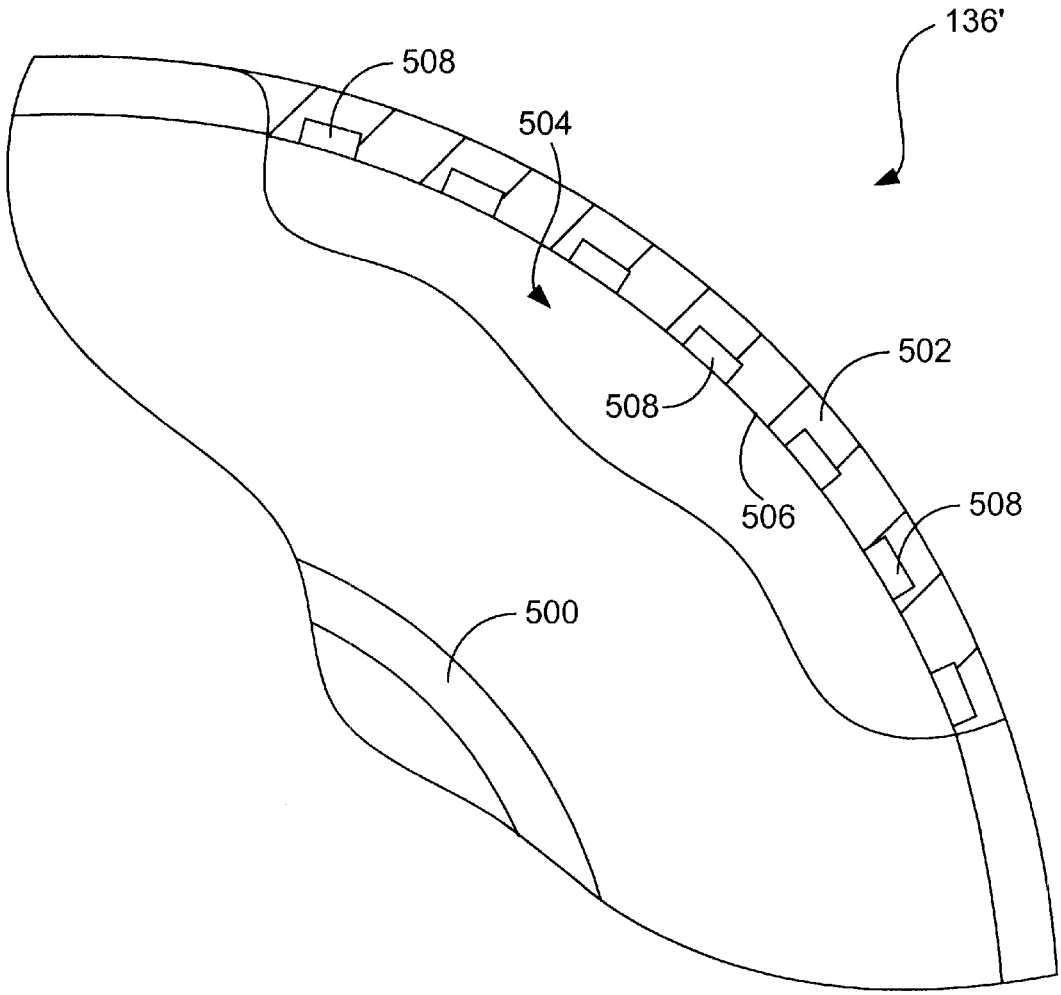
FIG. 5 is a partial, cut-away end view of an alternative fuser roller.

FIG. 5 illustrates an alternative fuser roller 136' that can be used in the fusing system 102. As indicated in this figure, the roller 136' includes an inner tube 500 and an outer tube 502 that together define an interior space 504. However, in the embodiment shown in FIG. 5, wicking material is not disposed within the interior space 504. Instead, the inner surface 506 of the outer tube 502 is provided with a plurality of grooves 508 that, due to the rotation of the fuser roller 136' and gravity, provide transport for condensation that forms on the outer tube when thermal loads are applied to the fuser roller 136'. By way of example, the grooves 508 can be helically arranged within the outer tube 502 in similar manner to rifling provided in gun barrels. The grooves 508 can further be arranged so as to draw the condensation outwardly toward the ends of the outer tube 502 where the tube is usually hottest. For instance, the grooves 508 can extend helically outward in opposite directions from the center of the outer tube 502 such that the condensation is forced towards the ends of the tube as it rotates.

Figure 6:
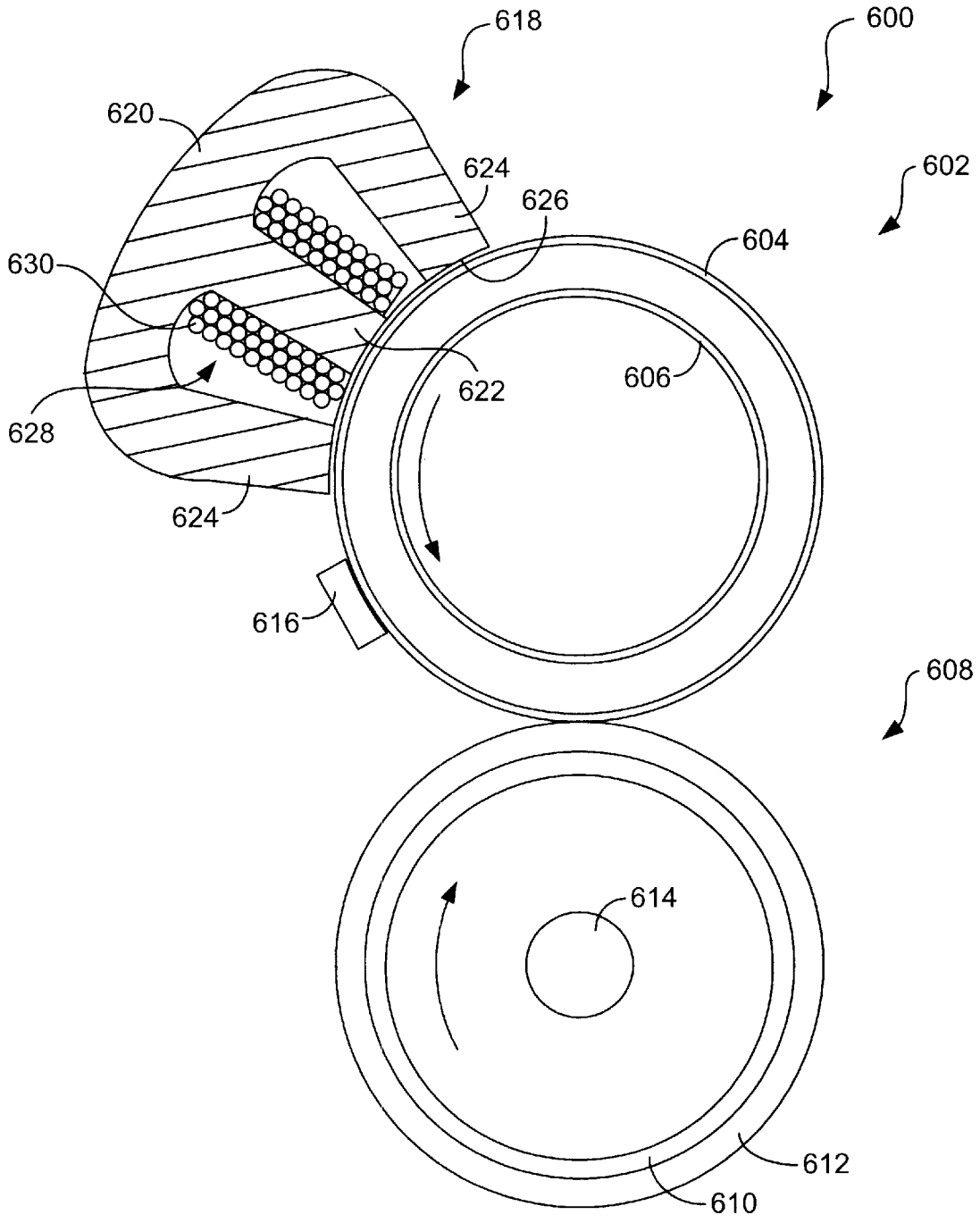
FIG. 6 is a partial cross-sectional end view of a second fusing system.
Figure 7:
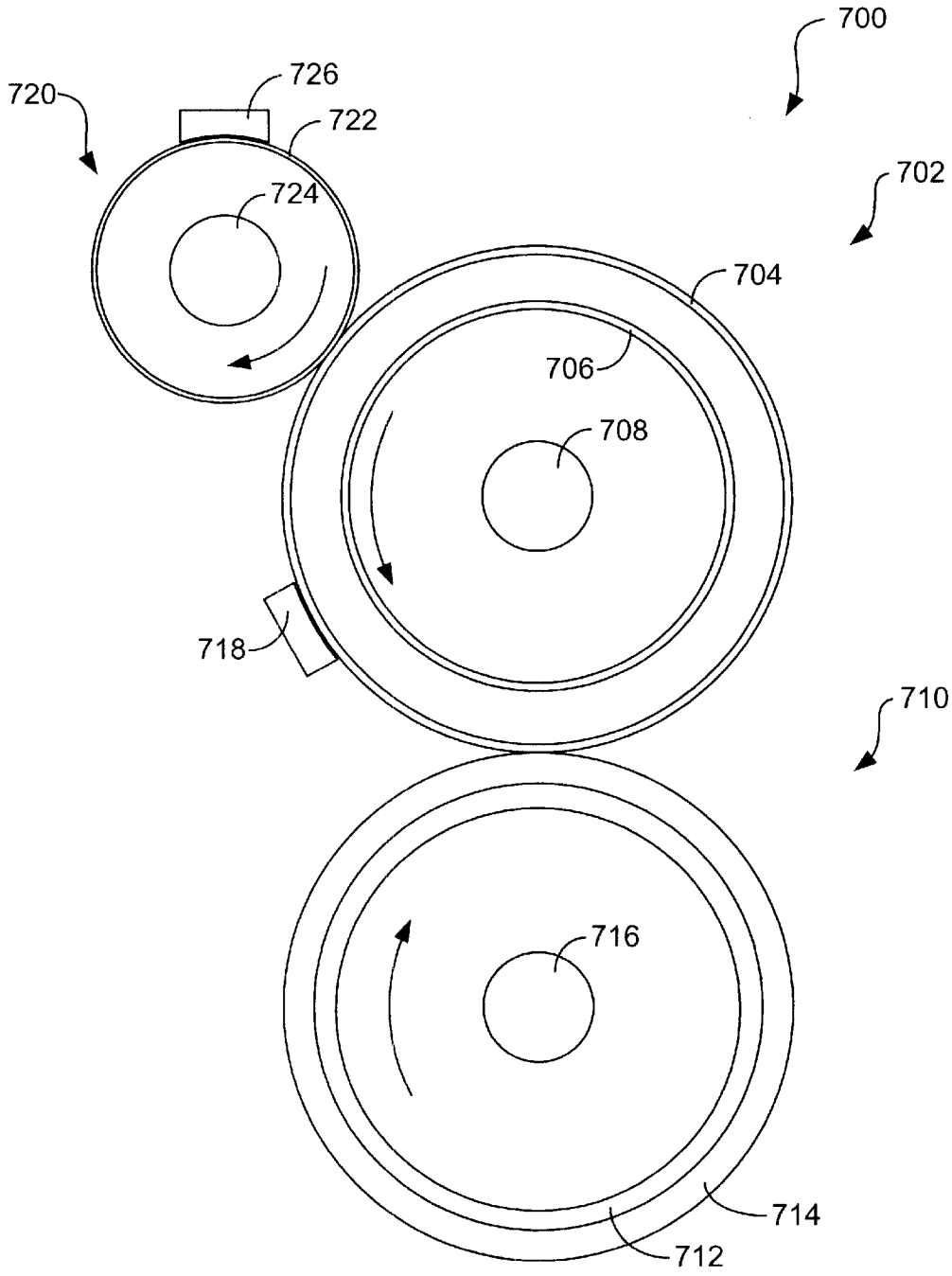
FIG. 7 is a simplified end view of a third fusing system.
Figure 8:
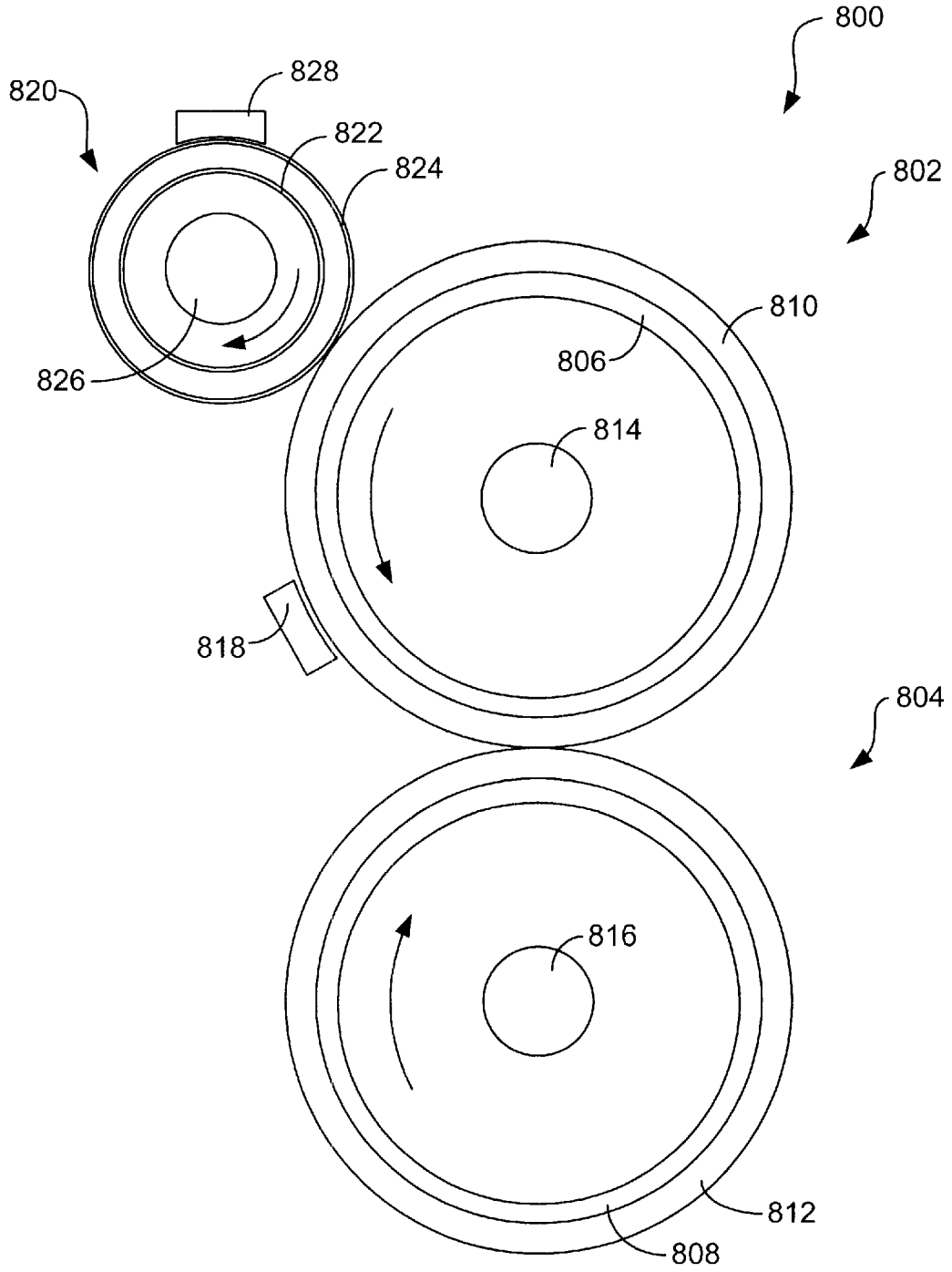
FIG. 8 is a simplified end view of a fourth fusing system.

As will be appreciated by persons having ordinary skill in the art, the fuser roller described above can, either alternatively or additionally, be heated externally. FIGS. 6–8 illustrate example alternative heating arrangements for the fuser roller. With reference first to FIG. 6, illustrated is a second fusing system 600. As indicated in this figure, the fusing system 600 is similar in construction to that shown in FIG. 2. Accordingly, the fusing system 600 includes a fuser roller 602 having a heat pipe configuration that incorporates an outer tube 604 and an inner tube 606, a pressure roller 608 formed as a hollow tube 610 having an outer layer 612 of elastomeric material and an internal heating element 614, and a temperature sensor 616. However, the fuser roller 602 is not internally heated but is instead externally heated with an external induction heating element 618.

The external induction heating element 618 is positioned in close proximity to the fuser roller 602 and, by way of example, is placed at the ten o'clock position. The external induction heating element 618 generally comprises a pole member 620 that includes a central pole 622 and opposed flux concentrators 624. As is apparent in FIG. 6, the central pole 622 and the flux concentrators 624 together form a concave surface 626 that preferably has a radius of curvature that closely approximates the radius of the fuser roller 602 such that a very small gap, e.g. between approximately 1 and 2 mm in width, is formed between the external induction heating element 618 and the fuser roller. The external induction heating element 618 further includes a coil 628 that is wrapped around the central pole 622. The coil 628 comprises a plurality of turns of a continuous conductive wire 630. In a preferred arrangement, the wire 630 comprises a copper Litz wire.

During operation of the fusing system 600, high frequency, e.g. approximately 10 kHz to 100 kHz, current is delivered by the power control circuit 150 (FIG. 1) to the coil 628. As the current flows through the coil 628, high frequency magnetic fluxes are generated in the central pole 622 of the external induction heating element 618. Due to the arrangement of the external induction heating element 618 and the fuser roller 602, the magnetic fluxes are focused upon the fuser roller and, therefore, upon the metal outer tube 604 of the fuser roller 602. The magnetic fluxes travel inside the outer tube 604 and cause it to produce induced eddy currents that generate heat in the outer tube, thereby heating the fuser roller 602.

With reference now to FIG. 7, illustrated is a third fusing system 700. As indicated in this figure, the fusing system 700 again is similar in construction to that shown in FIG. 2. Therefore, the fusing system 700 includes a fuser roller 702 incorporating an outer tube 704 and an inner tube 706 and having an internal heating element 708, a pressure roller 710 formed as a hollow tube 712 including an outer layer 714 of elastomeric material and having an internal heating element 716, and a temperature sensor 718. However, in addition to being internally heated, the fuser roller 702 is also externally heated with an external heating roller 720.

As indicated in FIG. 7, the external heating roller 720 comprises a hollow tube 722. The hollow tube 722 typically is composed of a metal such as aluminum or steel. To avoid a substantial increase in the height dimension of the fusing system 700, the tube 720 preferably has a relatively small diameter, e.g. approximately 1 in. In addition, the external heating roller 720 is preferably arranged at approximately the ten o'clock position relative to the fuser roller 702. The tube 722 can be thinner than the tubes 704 and 706 in that the external heating roller 720 is not compressed to form a nip. By way of example, this thickness can be approximately 0.03 in. Formed on the exterior of the hollow tube 722 is a layer of TEFLON® (not visible in FIG. 7) that, for instance, has a thickness of approximately 1.5 to 2 mils. Like the fuser and pressure rollers 702 and 704, the external heating roller 720 normally comprises an internal heating element 724 that, by way of example, comprises a tungsten filament halogen lamp or a nichrome heating element. When formed as tungsten filament halogen lamp, the internal heating element 724 can have a power rating of, for example, approximately 600 W. Also provided in the fusing system 700 is a second temperature sensor 726.

In operation, power is supplied to the heating elements 708, 716, and 724 by the control circuit 150 (FIG. 1) so as to heat each of the rollers 702, 710, and 720, respectively. It is to be noted that heating of the pressure roller 710 is optional in that enough heat may be provided by the internal heating elements 708 and 724 alone. Relatively moderate heating of the pressure roller 710 is deemed preferable however to avoid the accumulation of toner on the outer layer 710 of the pressure roller. By way of example, power is supplied to the heating elements 708, 716, and 724 such that the fuser and pressure rollers 702 and 710 are maintained at set point temperatures of approximately 185° C. to 195° C., and the external heating roller 720 is maintained at a set point temperature of approximately 220° C. to 240° C. In order to more precisely control heating and avoid temperature overshoot, the temperature of the fuser roller 702 and the external heating roller 720 are each preferably monitored individually with the separate temperature sensors 718 and 726 such that the power supplied to each of the heating elements 708 and 724 can be individually controlled. By way of example, this control can be provided with point controllers of the power control circuit 150.

FIG. 8 illustrates a fourth fusing system 800 that is a variant of the embodiment shown in FIG. 7. In the fusing system 800, the external heating roller 820 is configured as a heat pipe instead of the fuser roller. As indicated in FIG. 8, the fusing system 800 includes a fuser roller 802 and a pressure roller 804 that are each formed as hollow tubes 806 and 808 which have outer layers 810 and 812 of elastomeric materials. Each roller 802 and 804 includes an internal heating element 814 and 816 that typically comprises a tungsten filament halogen lamp or a nichrome heating element. In addition, the fusing system 800 includes a temperature sensor 818.

The external heating roller 820 is similar in construction to the fuser roller 136 described above. Accordingly, the external heating roller 820 comprises an inner tube 822 and a coaxial outer tube 824 that together form an interior space (not shown) in which a liquid can be injected and from which air can be evacuated. Typically, the outer surface of the outer tube 824 is coated with a layer of TEFLON® to prevent toner from accumulating on the fuser roller 136. Disposed within the inner tube 822 is an internal heating element 826 that typically comprises a tungsten filament halogen lamp or a nichrome heating element. Finally, the fusing system 800 includes a second temperature sensor 828 for the external heating roller 820.

In operation, power is supplied to the heating elements 814, 816, and 826 by the control circuit 150 so as to heat each of the rollers 802, 804, 820, respectively. Once the external heating roller 820 is heated to the system operating temperature, the liquid within its interior space is vaporized in similar manner to that described above in reference to the first embodiment. Again, as temperature gradients are formed, heat is distributed by the condensation and re-vaporization of the liquid across the external heating roller 820 to reduce these gradients.

While particular embodiments of the invention have been disclosed in detail in the foregoing description and drawings for purposes of example, it will be understood by those skilled in the art that variations and modifications thereof can be made without departing from the scope of the invention as set forth in the following claims.

What is claimed is:

1. A fusing system for fusing toner to a recording medium, comprising:

a fuser roller configured as a heat pipe including an inner tube and a coaxial outer tube that is mounted to the inner tube, the inner and outer tubes defining an interior space therebetween that is adapted to contain a liquid and to be evacuated via a port that is in fluid communication with the interior space so as to maintain the interior space in a vacuum; and a pressure roller in contact with the fuser roller.

2. The system of claim 1, wherein the fuser roller comprises wicking material that is disposed within the interior space.

3. The system of claim 1, wherein the outer tube of the fuser roller comprises a plurality of grooves that provide transport for liquid within the interior space.

4. The system of claim 1, further comprising an internal heating element disposed within the fuser roller.

5. The system of claim 1, further comprising an external induction heating element disposed adjacent an outer surface of the fuser roller.

6. The system of claim 1, further comprising an external heating roller that contacts an outer surface of the fuser roller.

7. A fusing system for fusing toner to a recording medium, comprising:

a fuser roller;

a pressure roller in contact with the fuser roller; and a heating roller external to and in contact with the fuser roller, the heating roller being configured as a heat pipe including an inner tube and a coaxial outer tube that is mounted to the inner tube, the inner and outer tubes defining an interior space therebetween that is adapted to contain a liquid and to be evacuated via a port that is in fluid communication with the interior space so as to maintain the interior space in a vacuum.

8. A fusing system for fusing toner to a recording medium, comprising:

a fuser roller including means for redistributing heat along the length of the fuser roller such that relatively cool regions of the roller are heated and relatively hot regions of the fuser roller are cooled, the means for redistributing heat comprising an interior space of the fuser roller that contains a liquid and which is maintained in a vacuum; and a pressure roller in contact with the fuser roller.

9. The system of claim 8, wherein the fuser roller comprises an inner tube and a coaxial outer tube mounted to the inner tube, the inner and outer tubes together defining the interior space.

10. A fuser roller for use in a fusing system, comprising:

an inner tube;

an outer tube that surrounds the inner tube and which is coaxial with the inner tube; and an interior space defined by the inner tube and the outer tube, the interior space being adapted to receive liquid and to be evacuated such that the space is maintained in a vacuum.

11. The fuser roller of claim 10, further comprising wicking material that is disposed within the interior space and is capable of drawing condensation away from portions of the outer tube.

12. The fuser roller of claim 10, wherein the outer tube comprises a plurality of grooves that provide transport for liquid within the interior space.

13. The fuser roller of claim 10, further comprising spacers that extend between the inner and outer tubes and further define the interior space.

14. The fuser roller of claim 10, further comprising an internal heating element that is disposed within the fuser roller.

15. A device in which toner is fused to a recording medium, comprising:

means for attracting toner to a surface of the recording medium; and a fusing system including a fuser roller configured as a heat pipe including an inner tube and a coaxial outer tube that is mounted to the inner tube, the inner and outer tubes defining an interior space therebetween that is adapted to contain a liquid and to be evacuated so as to be maintained in a vacuum, and a pressure roller in contact with the fuser roller.

16. The device of claim 15, wherein the fuser roller comprises wicking material that is disposed within the interior space.

17. The device of claim 15, wherein the outer tube of the fuser roller comprises a plurality of grooves that provide transport for liquid within the interior space.

18. A method for distributing heat in a fusing system, comprising the steps of:

providing a fuser roller including an interior space maintained in a vacuum that contains a liquid;

heating the fuser roller until the liquid within the interior space is vaporized; and distributing heat within the fuser roller via continual condensation and re-vaporization of the liquid within the interior space.

19. A method for distributing heat in a fusing system, comprising the steps of:

providing a heating roller including an interior space maintained in a vacuum that contains a liquid;

placing the heating roller in rolling contact with a fuser roller of the fusing system;

heating the heating roller until the liquid within the interior space is vaporized; and distributing heat within the heating roller via continual condensation and re-vaporization of the vaporized liquid within the interior space.

* * * * *